US005505184A

United States Patent [19]

Uchikawa

[11] Patent Number: 5,505,184

[45] Date of Patent: Apr. 9, 1996

[54] METHOD AND APPARATUS FOR CONTROLLING THE AIR-FUEL RATIO OF AN INTERNAL COMBUSTION ENGINE

[75] Inventor: Akira Uchikawa, Atsugi, Japan

[73] Assignee: Unisia Jecs Corporation, Atsugi, Japan

[21] Appl. No.: 395,603

[22] Filed: Feb. 27, 1995

[30] Foreign Application Priority Data

Feb. 28, 1994 [JP] Japan ..... 6-028636

[51] Int. Cl.[6] ..... F02D 41/00

[52] U.S. Cl. ..... 123/674

[58] Field of Search ..... 123/674, 675, 123/679, 695; 60/274, 276, 285

[56] References Cited

U.S. PATENT DOCUMENTS 5,320,080 6/1994 Kadowaki ..... 123/674
5,341,641 8/1994 Nakajima et al. ..... 60/274
5,381,774 1/1995 Nakajima ..... 123/674
5,400,762 3/1995 Fodale et al. ..... 123/674
5,404,718 4/1995 Orzel et al. ..... 60/274

FOREIGN PATENT DOCUMENTS 60-240840 11/1985 Japan ..... 123/674

*Primary Examiner*—Raymond A. Nelli
*Attorney, Agent, or Firm*—Foley & Lardner

[57] ABSTRACT

Air-fuel ratio learning is only carried out at the time of high exhaust temperatures, and is inhibited when the exhaust temperature is less than or equal to a predetermined temperature. In the latter case, air-fuel ratio feedback correction coefficient α is correctingly set, taking a correction level indicated by an air-fuel ratio learned correction coefficient K learned at the time of high exhaust temperatures as a true correction requirement level.

10 Claims, 4 Drawing Sheets

METHOD AND APPARATUS FOR CONTROLLING THE AIR-FUEL RATIO OF AN INTERNAL COMBUSTION ENGINE

FIELD OF THE INVENTION

The present invention relates to a method and apparatus for controlling the air-fuel ratio of an internal combustion engine, and more particularly to technology for maintaining air-fuel ratio control accuracy, by dealing with changes in oxygen concentration detection characteristics due to exhaust temperature.

DESCRIPTION OF THE RELATED ART

There is known a conventional type of air-fuel ratio control apparatus which judges the richness/leanness of the actual air-fuel ratio with respect to a target air-fuel ratio (stoichiometric air-fuel ratio), based on oxygen concentration in the exhaust detected by an oxygen sensor, and feedback controls a fuel supply amount to the engine based on the judgement result, so that the actual air-fuel ratio approaches the stoichiometric air-fuel ratio (target air-fuel ratio) (refer to Japanese Unexamined Patent Publication No. 60-240840).

With this apparatus, the output characteristics of the detection signal produced by the oxygen sensor, change due to the sensor element temperature influenced by the exhaust temperature, so that even with the element active, if due to low exhaust temperatures the element temperature becomes relatively low, there is the possibility of for example an increase in lean output, with consequent variation of the control point for the air-fuel ratio feedback control to the lean side.

Therefore, under low exhaust temperature conditions such as immediately after starting, or with low ambient temperatures and low load operation, there is the likelihood of a deterioration in engine operability and exhaust conditions, due to reduced accuracy in controlling to the target air-fuel ratio.

SUMMARY OF THE INVENTION

The present invention takes into consideration the above situation, with the object of controlling the air-fuel ratio stably and precisely without influence from the exhaust temperature.

To achieve the above objective with the method and apparatus according to the present invention for controlling the air-fuel ratio of an internal combustion engine, an air-fuel ratio feedback correction value for correcting a fuel supply quantity of a fuel supply device, is set in a direction so that the air-fuel ratio of the engine intake mixture approaches a target air-fuel ratio, based on the oxygen concentration in the engine exhaust gas, while a correction requirement indicated by the air-fuel ratio feedback correction value is learned as an air-fuel ratio learned correction value for different operating conditions. Here, when the exhaust temperature is less than or equal to a predetermined temperature, learning of the air-fuel ratio learned correction value is inhibited, and the air-fuel ratio feedback correction value is correctingly set to be approximately equal to a correction level for a fuel supply quantity due only to an air-fuel ratio learned correction value for the relevant operating conditions.

With such a construction, at the time of a low exhaust temperature with the likelihood of a change in oxygen concentration detection characteristics, air-fuel ratio learning is inhibited to avoid erroneous learning. On the other side, the air-fuel ratio feedback correction value is correctingly set using the learned result at the time of a high exhaust temperature as an appropriate correction level for the relevant operating conditions, so that erroneous control due to the beforementioned change in detection characteristics is prevented.

With the method and apparatus according to the present invention for controlling the air-fuel ratio of an internal combustion engine, the air-fuel ratio learned correction value is learned for each of a plurality of operating conditions divided by engine rotational speed and engine load.

With such a construction, the air-fuel ratio learned correction value can be learned in accordance with different correction requirements for engine rotational speed and engine load.

Moreover, with the method and apparatus according to the present invention for controlling the air-fuel ratio of an internal combustion engine, the air-fuel ratio feedback correction value and the air-fuel ratio learned correction value are correction terms respectively multiplied by the basic fuel supply quantity, so that when the exhaust temperature is less than or equal to a predetermined temperature, the air-fuel ratio feedback correction value is correctingly set with the deviation of the air-fuel ratio learned correction value, and the multiplied result of the air-fuel ratio feedback correction value and air-fuel ratio learned correction value, as an additive correction value.

With such a construction, even if air-fuel ratio feedback correction is carried out while using the air-fuel ratio learned correction value learned at the time of high exhaust temperature, the air-fuel ratio is corrected at an appropriate level approximately equivalent to this air-fuel ratio learned correction value.

Furthermore, with the method and apparatus according to the present invention for controlling the air-fuel ratio of an internal combustion engine, the exhaust temperature is indirectly detected on the basis of at least one of; cooling water temperature, ambient temperature, engine load, and elapsed time from start.

With such a construction, the exhaust temperature can be indirectly detected using a previously installed sensor, thus obviating the need to newly install a sensor for directly detecting the exhaust temperature.

Moreover, with the method and apparatus according to the present invention for controlling the air-fuel ratio of an internal combustion engine, the beforementioned predetermined temperature may be approximately 400 degrees C.

With such a construction, when the exhaust temperature less than or equal to approximately 400 degrees C., with the likelihood of error in the control point for the air-fuel ratio feedback control due to the change in the oxygen concentration detection characteristics, learning can be inhibited, and the air-fuel ratio feedback correction value can be correctingly set based on the high temperature learned results.

Other objects and aspects of the present invention will become apparent from the following description of embodiment given in conjunction with the appended drawings.

DETAILED DESCRIPTION OF THE PREFERRED EMBODIMENTS

As follows is a description of embodiment of the present invention.

Figure 1:
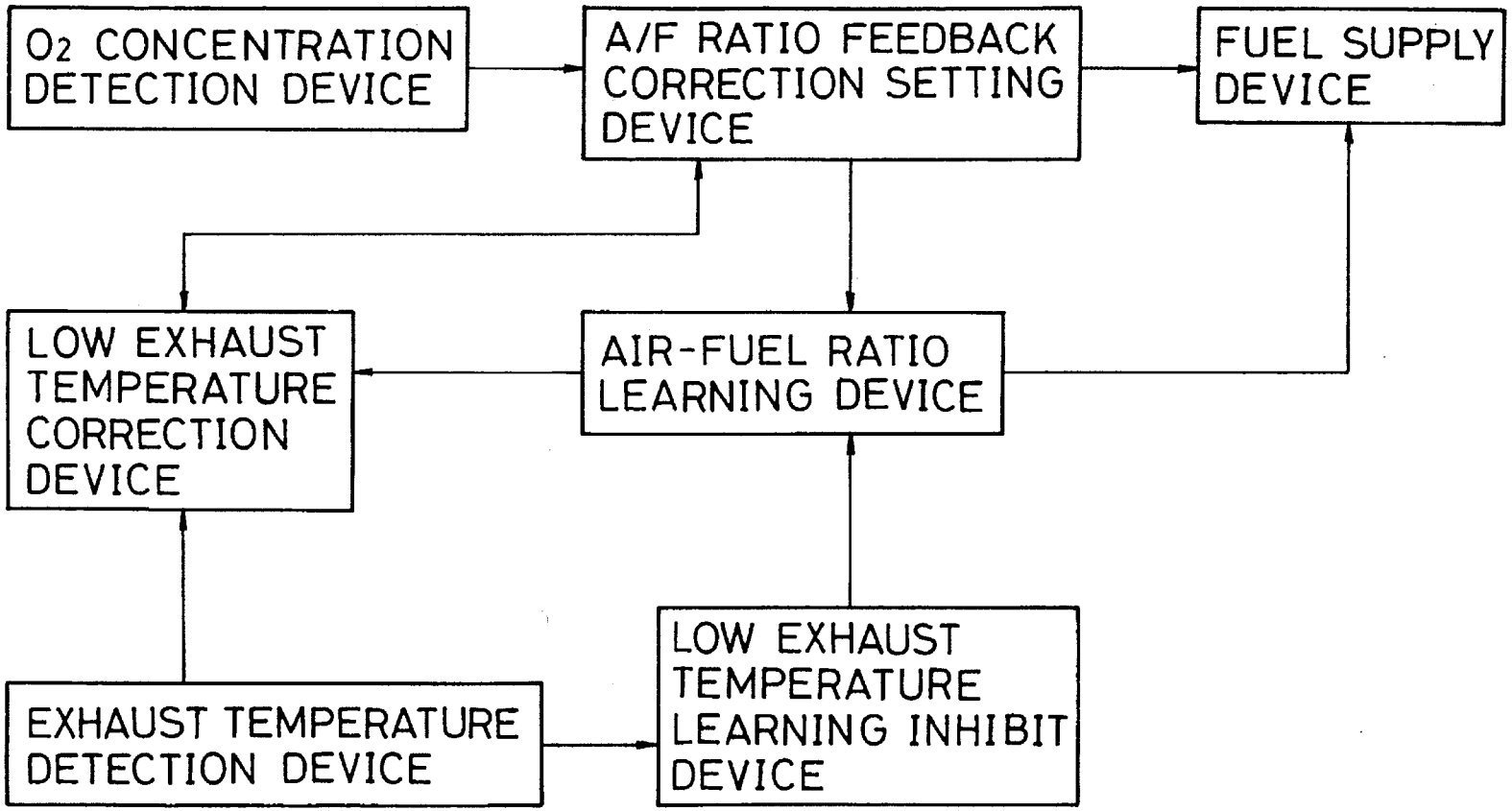
FIG. 1 is a block diagram showing a basic construction of an air-fuel ratio control apparatus according to a first aspect of the present invention.
Figure 2:
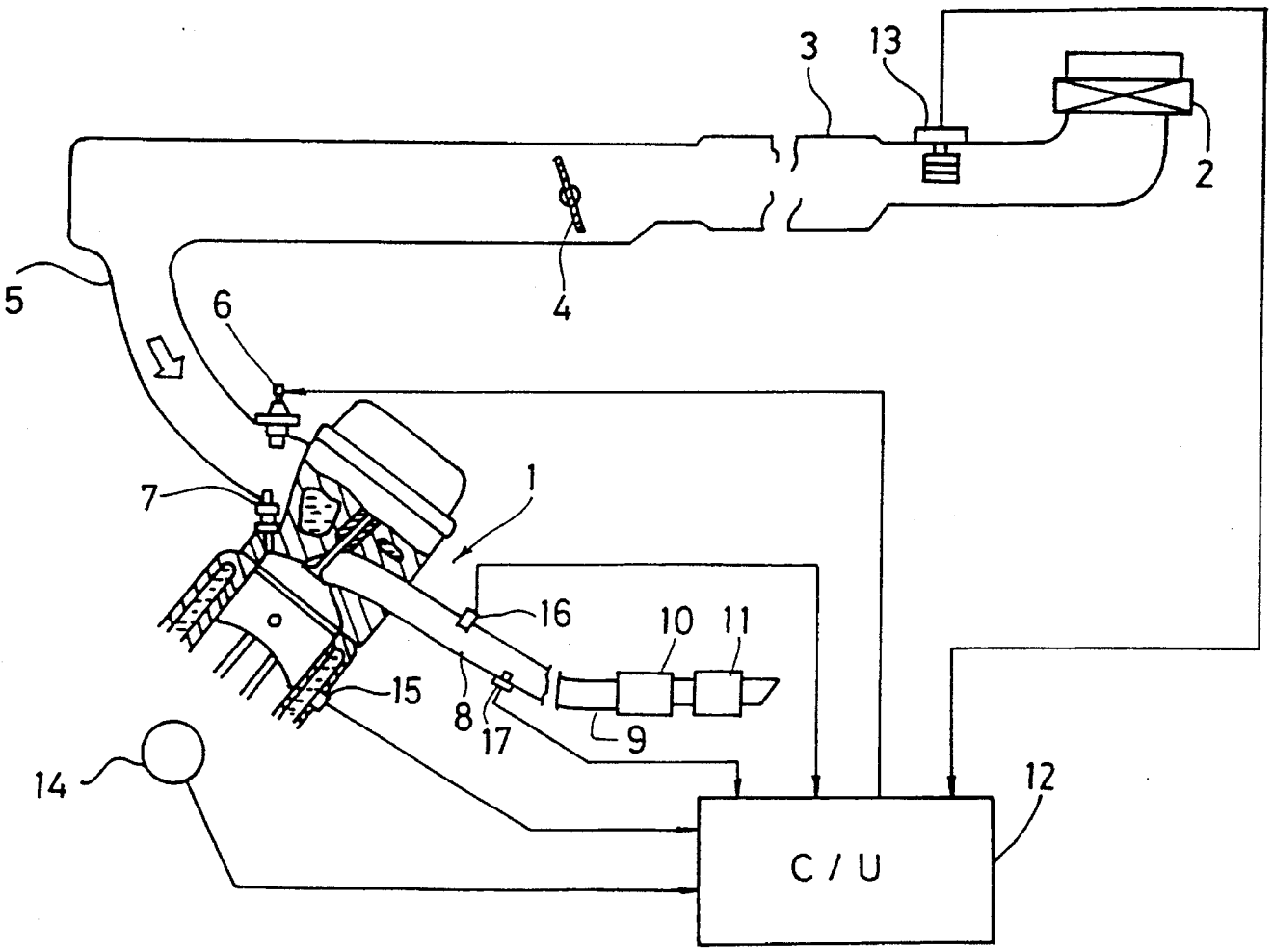
FIG. 2 is a schematic system diagram illustrating an embodiment of the present invention.

With the embodiment shown in FIG. 2, an internal combustion engine 1 draws in air from an air cleaner 2 by way of an intake duct 3, a throttle valve 4, and an intake manifold 5. Fuel injection valves 6 are provided as fuel supply devices (see FIG. 1) for each cylinder, in respective branch portions of the intake manifold 5.

The fuel injection valves 6 are electromagnetic type fuel injection valves which open with power to a solenoid and close with power shut-off. The injection valves 6 are driven open in response to an injection pulse signal provided by a control unit 12 (to be described later) so that fuel pressurized by a fuel pump (not shown), and controlled to a predetermined pressure by means of a pressure regulator, is injected intermittently to the engine 1.

Ignition plugs 7 are provided for each combustion chamber of the engine 1, for spark ignition of a mixture therein. Exhaust from the engine 1 is discharged by way of an exhaust manifold 8, an exhaust duct 9, a three-way catalytic converter 10 and a muffler 11.

The control unit 12 incorporates a microcomputer having for example a CPU, ROM, RAM, A/D converter and input/output interface. Input signals from the various sensors are received by the control unit 12, and computational processing carried out (as described later) to thereby control the operation of the fuel injection valves 6.

For the various sensors there is provided in the intake duct 3, an airflow meter 13, which outputs a signal corresponding to an intake air quantity Q of the engine 1.

Also provided is a crank angle sensor 14 which outputs a reference crank angle signal REF for each reference piston position, and a unit crank angle signal POS for each 1° or 2° crank angle. The period of the reference crank angle signals REF or the number of unit crank angle signals POS within a predetermined period, is measured to compute the engine rotational speed Ne.

Moreover, a water temperature sensor 15 is provided for detecting the cooling water temperature Tw in the water jacket of the engine 1.

There is also an oxygen sensor oxygen sensor 16, provided as an oxygen concentration detection device (see FIG. 1), at a junction portion of the exhaust manifold 8.

The oxygen sensor 16 is a known zirconium oxide tube type oxygen concentration cell which generates an electromotive force corresponding to a ratio of the oxygen concentration in the exhaust to that in the atmosphere (reference oxygen concentration). The oxygen sensor 16 is one which detects only the stoichiometric air-fuel ratio (rich or lean with respect to a target air-fuel ratio) utilizing the fact that the concentration of oxygen in the exhaust gas drastically changes around the stoichiometric air-fuel ratio (the target air-fuel ratio in the present embodiment). With the present embodiment, the oxygen sensor 16 is provided with a heater to keep it in an active condition, even under low exhaust temperature conditions such as immediately after starting.

Moreover, an exhaust temperature sensor 17 is provided in the exhaust system, as an exhaust temperature detection device (see FIG. 1) for detecting the temperature of the engine exhaust.

The CPU of the microcomputer in the control unit 12 computes the fuel injection quantity (fuel injection pulse width) Ti for the fuel injection valves as;

$$Ti \leftarrow Tp \times CO \times \alpha K + Ts$$

Here Tp is the basic fuel injection quantity (basic fuel injection pulse width) computed based on the intake air quantity Q and the engine rotational speed Ne, while CO is the respective correction coefficients for correcting the basic fuel injection quantity Tp, corresponding to engine operating conditions such as cooling water temperature, and transient operation. Moreover $\alpha$(originally equal to 1.0) is the air-fuel ratio feedback correction coefficient (air-fuel ratio feedback correction value) for correcting the basic fuel injection quantity Tp in a direction so that the air-fuel ratio detected by the oxygen sensor 16 approaches the stoichiometric air-fuel ratio. This may be set for example, by proportional-plus-integral control.

Furthermore, K is an air-fuel ratio learned correction coefficient (air-fuel ratio learned correction value), which is stored, in rewritable form, for each of a plurality of operating conditions divided by basic fuel injection quantity Tp and engine rotational speed Ne. A correction level indicated by the air-fuel ratio feedback correction coefficient $\alpha$ is learned for each of the operating conditions and the stored data rewritten. More specifically, correction requirements indicated by the air-fuel ratio feedback correction coefficient oc, are learned and stored as air-fuel ratio learned correction coefficients K for each of the operating regions, so that the air-fuel ratio obtained by correction using the air-fuel ratio learned correction coefficient K, is stabilized in the vicinity of the stoichiometric air-fuel ratio, without correction by the air-fuel ratio feedback correction coefficient $\alpha$.

Moreover, Ts is a voltage correction amount for correcting a change in the ineffective injection period of the fuel injection valve 6 due to a change in battery voltage.

Figure 4:
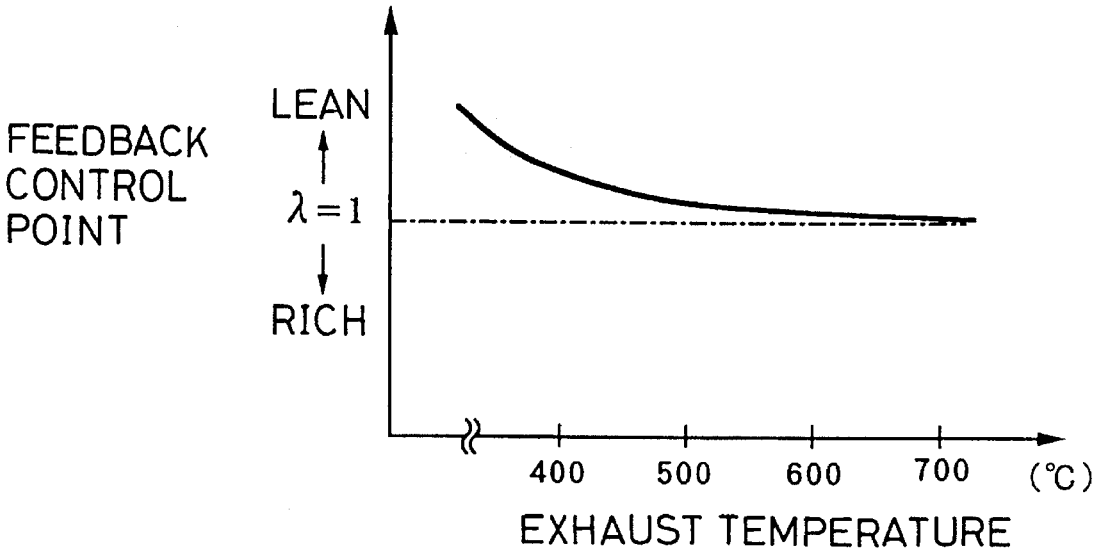
FIG. 4 is a graph for explaining problems with conventional control.
Figure 5:
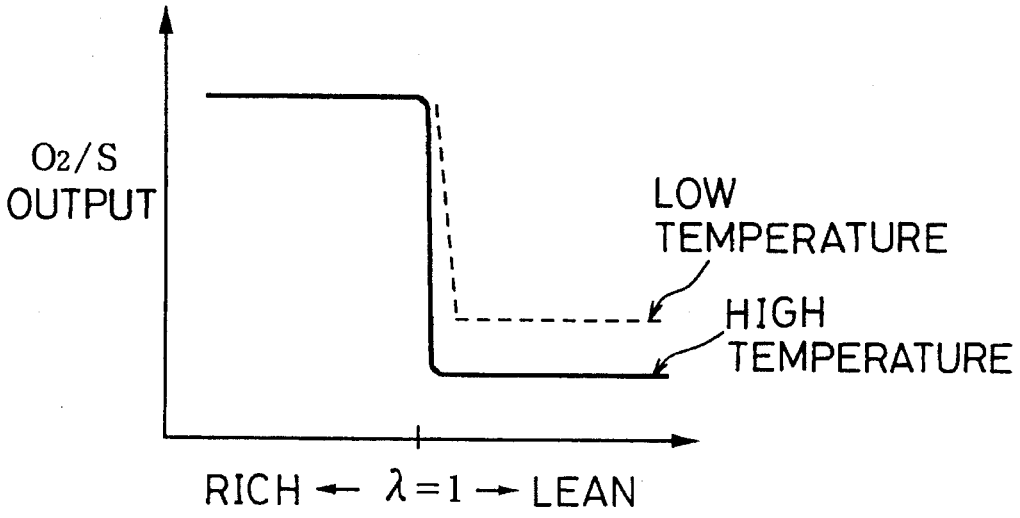
FIG. 5 is a graph showing changes in output characteristics of an oxygen sensor due to exhaust temperature.

Incidentally, even with the oxygen sensor 16 heated by a heater, there will still be a change in the output characteristics of the oxygen sensor 16 with a drop in element temperature (see FIG. 5), under low exhaust temperature conditions such as immediately after starting, or with low ambient temperatures, or with low load operation. Moreover, the resultant change in output characteristics will influence the air-fuel ratio feedback control which uses the oxygen sensor 16, causing a variation of the control point from the target air-fuel ratio (see FIG. 4).

Figure 3:
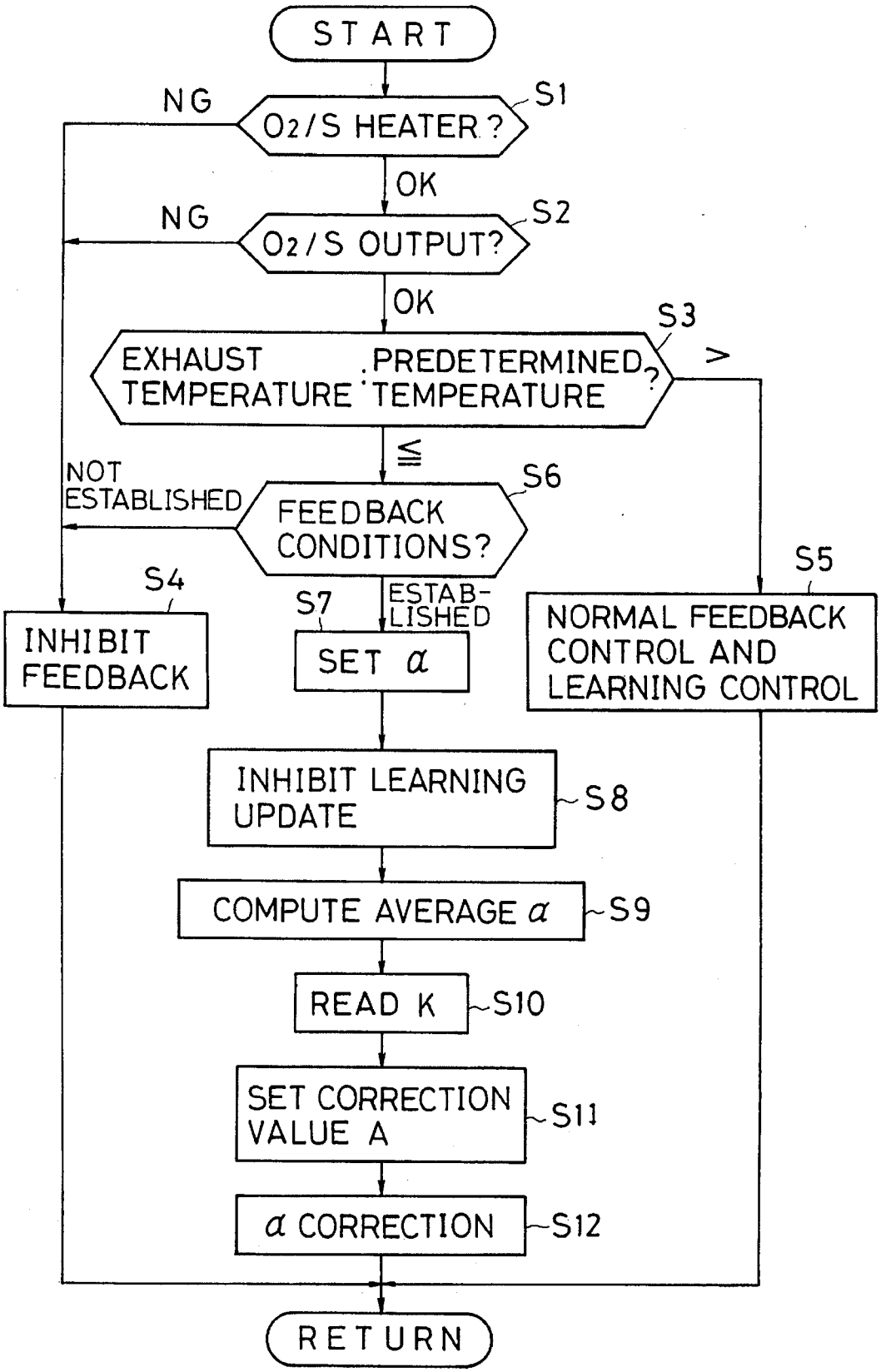
FIG. 3 is a flow chart showing an air-fuel ratio feedback control routine of the embodiment.

With the present embodiment, the control unit 12 avoids deterioration in air-fuel ratio control accuracy occurring with low exhaust temperature conditions, by control as illustrated by the flow chart in FIG. 3.

In this respect, the functions of the air-fuel ratio feedback correction value setting device, the air-fuel ratio learning device, the low exhaust temperature correction device, and the low exhaust temperature learning inhibit device (see FIG. 1) are realized by software illustrated by the flow chart of FIG. 3 and stored in the control unit 12.

In the flow chart of FIG. 3, initially in step 1 (with "step" denoted by S in the figures), it is judged if the heater provided for the oxygen sensor 16 is faulty. More specifically, a diagnosis is made of the heater power circuit for disconnections or short circuit, and if the heater is operating normally control proceeds to step 2.

In step 2, the oxygen sensor 16 is checked for faults by judging its output. When the output is normal, control proceeds to step 3.

In step 1 or step 2, if a heater fault or oxygen sensor 16 fault is determined, control proceeds to step 4 where the air-fuel ratio feedback control using the oxygen sensor 16 is inhibited, giving an open control condition.

In step 3, it is judged if the exhaust temperature detected by the exhaust temperature sensor 17 is less than or equal to a predetermined temperature (for example 400° C.).

The predetermined temperature is the minimum temperature at which the expected output characteristics of the oxygen sensor 16 can be obtained. Therefore, when the exhaust temperature rises above this predetermined temperature, the actual air-fuel ratio can be controlled to the target air-fuel ratio (the stoichiometric air-fuel ratio) by setting the air-fuel ratio feedback correction coefficient α based on the output of the oxygen sensor 16. Accordingly, when judged in step 3 that the exhaust temperature exceeds the predetermined temperature, control proceeds to step 5 where, in the predetermined feedback control regions, the air-fuel ratio feedback correction coefficient α is set based on the output of the oxygen sensor 16, and normal air-fuel ratio control is carried out with the correction level indicated by the air-fuel ratio feedback correction coefficient α being learned as the air-fuel ratio learned correction coefficient K.

On the other hand, when judged in step 3 that the exhaust temperature is less than or equal to the predetermined temperature, this is the condition wherein the oxygen sensor 16 will not realize its expected output characteristics due to low exhaust temperature. Hence, if air-fuel ratio feedback control is carried out as usual, there is the possibility of deterioration in operability and exhaust performance, due to control point variation from the target air-fuel ratio (see FIG. 4).

Therefore in step 3, when judged that the exhaust temperature is less than or equal to the predetermined temperature, control proceeds instead to step 6 and the subsequent steps, and not to step 5, and control is carried to deal with changes in the output characteristics of the oxygen sensor 16.

In step 6 it is judged if the predetermined operating region for carrying out air-fuel ratio feedback control exists. If not, control proceeds to step 4 to give an open control condition wherein setting of the air-fuel ratio feedback correction coefficient α is not carried out (ie. the correction coefficient α is clamped).

When judged in step 6 that the air-fuel ratio feedback control region exists, control proceeds to step 7, where the air-fuel ratio feedback correction coefficient α is set based on the output of the oxygen sensor 16.

Here, if conditions were normal, learning and updating of the air-fuel ratio learned correction coefficient K would be carried out based on the air-fuel ratio feedback correction coefficient α set in step 7. However, since it was predicted in step 3 that due to the low exhaust temperature, there will be a change in the output characteristics of the oxygen sensor 16, then in the next step 8, the learning and updating of the air-fuel ratio learned correction coefficient K is inhibited, and air-fuel ratio learning correction is carried out using the air-fuel ratio learned correction coefficient K learned for the high temperature conditions without updating.

That is to say, when the output characteristics of the oxygen sensor 16 are changed due to the low exhaust temperature (see FIG. 5), if the air-fuel ratio learned correction coefficient K is learned and updated based on the air-fuel ratio feedback correction coefficient α at that time, then due to variation of the air-fuel ratio feedback control point from the target air-fuel ratio (see FIG. 4), learning will be made with this control point variation from the target air-fuel ratio. As a result, when the exhaust temperature rises, the air-fuel ratio learned correction will be carried out based on the erroneously learned result, with deterioration in the air-fuel ratio control accuracy. Therefore, when a low exhaust temperature condition wherein the change in output characteristics of the oxygen sensor 16 is predicted, the learning and updating of the air-fuel ratio learned correction coefficient K is inhibited to prevent erroneous learning.

In the next step 9, the average value of the air-fuel ratio feedback correction coefficient α(the average of the maximum and minimum values ) is computed, and in step 10, the air-fuel ratio learned correction coefficient K corresponding to the current basic fuel injection quantity Tp and engine rotational speed Ne is read from a map. Then, since as mentioned before, air-fuel ratio learning is inhibited at the time of low exhaust temperatures, the read air-fuel ratio learned correction coefficient K, becomes the learned value for the high exhaust temperature conditions.

With a construction wherein the air-fuel ratio feedback correction coefficient α is set using proportional control during air-fuel ratio inversion, and integral control between inversions, the average value in step 9 is obtained by averaging the maximum and minimum values of the correction coefficient α obtained for each proportional control for each air-fuel ratio inversion.

Moreover, in step 11, the deviation of the air-fuel ratio learned correction coefficient K, and the current air-fuel ratio correction value (equal to the average value of the air-fuel ratio feedback correction coefficient α multiplied by the air-fuel ratio learned correction coefficient K), is set as a correction value A. Then in step 12, the correction value A is added to the air-fuel ratio feedback correction coefficient α to correctingly set the correction coefficient α . Now when the average value is obtained for each air-fuel ratio inversion, then the beforementioned correction of the correction coefficient α is carried out for each air-fuel ratio inversion.

The air-fuel ratio learned correction coefficient K read in step 10, is the value which is learned for the required correction level to obtain the target air-fuel ratio occurring under current engine operating conditions (conditions with the same basic fuel injection quantity Tp and engine rotational speed Ne) although the exhaust temperature condition is different from that at the learning control. Here if learning continues, then under high temperature conditions, the target air-fuel ratio is obtained by changing the correction coefficient α about the original value of 1.0, and correction requirements are indicated by the air-fuel ratio learned correction coefficient K only.

On the other hand, since the air-fuel ratio feedback correction coefficient α set in step 7, has its value set using the oxygen sensor 16 which outputs oxygen concentration detection signals with characteristics different from the expected output characteristics due to the low exhaust temperature conditions, then some variation from the control point can be predicted.

Since the overall correction level indicated by the air-fuel ratio feedback correction coefficient α and the air-fuel ratio learned correction coefficient K, should be nearly constant and not dependent on the exhaust temperature, then the deviation of the air-fuel ratio learned correction coefficient K, and the average value of the air-fuel ratio feedback correction coefficient α multiplied by the air-fuel ratio learned correction coefficient K, indicates the error in the control point produced by the change in the output characteristics of the oxygen sensor 16, due to the low exhaust temperature conditions.

Accordingly the air-fuel ratio learned correction coefficient K is taken as showing the true correction requirement level, and the abovementioned deviation is added to the air-fuel ratio feedback correction coefficient α so that correction of an approximately equivalent level to that for the high exhaust temperature condition is carried out. As a result the variation in the air-fuel ratio feedback control point due to the change in the output characteristics of the oxygen sensor 16 under low exhaust temperature conditions is corrected.

Consequently, even under conditions such as immediately after starting, or with low ambient temperatures, or low load operation and under conditions wherein exhaust temperatures are low and the expected output characteristics of the oxygen sensor 16 are not obtained, feedback control approaching the target air-fuel ratio is possible, so that engine operability and exhaust performance can be improved.

In the above embodiment, the air-fuel ratio feedback correction coefficient α is proportional-plus-integral controlled. However, the invention is not limited to this control method, and other methods such as for example proportional-plus-integral-plus-differential control are also possible.

Moreover, a construction is also possible wherein, as well as stopping the learning and updating of the air-fuel ratio learned correction coefficient K under low exhaust temperature conditions, the learning correction using the air-fuel ratio learned correction coefficient K is also stopped. In this case, correction setting of the correction coefficient α may be carried out with the deviation of the learned correction coefficient K learned at the time of high exhaust temperature, and the air-fuel ratio feedback correction coefficient α for the time of low exhaust temperature, as the correction value A.

Moreover, with the present embodiment a sensor which directly detects the exhaust temperature is provided. However a construction is also possible wherein exhaust temperature is indirectly detected from information such as cooling water temperature, ambient temperature, engine load, and elapsed time from starting. Furthermore, the exhaust temperature conditions may be estimated from the output level of the oxygen sensor 16.

I claim:

1. An apparatus for controlling the air-fuel ratio of an internal combustion engine, said apparatus comprising;

oxygen concentration detection means for detecting oxygen concentration in the engine exhaust gas, air-fuel ratio feedback correction value setting means for setting, based on the oxygen concentration detected by said oxygen concentration detection means, an air-fuel ratio feedback correction value for correcting a fuel injection quantity by a fuel injection means, in a direction so that an air-fuel ratio of the engine intake mixture approaches a target air-fuel ratio, air-fuel ratio learning means for learning, as an air-fuel ratio learned correction value, a correction requirement indicated by said air-fuel ratio feedback correction value for different operating conditions, exhaust temperature detection means for detecting an exhaust temperature of the engine, low exhaust temperature learning inhibit means for inhibiting learning of the air-fuel ratio learned correction value by said air-fuel ratio learning means, when the exhaust temperature detected by said exhaust temperature detection means is less than or equal to a predetermined temperature, and low exhaust temperature correction means for correctingly setting said air-fuel ratio feedback correction value to be approximately equal to a correction level for a fuel supply quantity due only to an air-fuel ratio learned correction value for the relevant operating conditions, when the exhaust temperature detected by said exhaust temperature detection means is less than or equal to a predetermined temperature.

2. An apparatus for controlling the air-fuel ratio of an internal combustion engine according to claim 1, wherein said air-fuel ratio learning means learns an air-fuel ratio learned correction value for each of a plurality of operating conditions divided by engine rotational speed, and engine load.

3. An apparatus for controlling the air-fuel ratio of an internal combustion engine according to claim 1, wherein said air-fuel ratio feedback correction value and air-fuel ratio learned correction value are correction terms respectively multiplied by the basic fuel supply quantity, and said low exhaust temperature correction means correctingly sets said air-fuel ratio feedback correction value with the deviation of the multiplied result of the air-fuel ratio feedback correction value and the air-fuel ratio learned correction value, and said air-fuel ratio learned correction value as an additive correction value.

4. An apparatus for controlling the air-fuel ratio of an internal combustion engine according to claim 1, wherein said exhaust temperature detection means indirectly detects the exhaust temperature on the basis of at least one of cooling water temperature, ambient temperature, engine load, and elapsed time from start.

5. An apparatus for controlling the air-fuel ratio of an internal combustion engine according to claim 1, wherein said predetermined temperature is approximately 400 degrees C.

6. A method of controlling the air-fuel ratio of an internal combustion engine, said method comprising;

an oxygen concentration detection step for detecting oxygen concentration in the engine exhaust gas, an air-fuel ratio feedback correction value setting step for setting, based on the oxygen concentration in the engine exhaust gas, an air-fuel ratio feedback correction value for correcting a fuel injection quantity by a fuel injection means, in a direction so that an air-fuel ratio of the engine intake mixture approaches a target air-fuel ratio, an air-fuel ratio learning step for learning, as an air-fuel ratio learned correction value, a correction requirement indicated by said air-fuel ratio feedback correction value for different operating conditions, an exhaust temperature detection step for detecting an exhaust temperature of the engine, a learning inhibit step for inhibiting learning of the air-fuel ratio learned correction value, when said exhaust temperature is less than or equal to a predetermined temperature, a correction step for correctingly setting said air-fuel ratio feedback correction value to be approximately equal to a correction level for a fuel supply quantity due only to an air-fuel ratio learned correction value for the relevant operating conditions, when said exhaust temperature is less than or equal to a predetermined temperature, and a step for controlling the fuel supplied by said fuel supply means, based on the fuel supply quantity correctingly set based on said air-fuel ratio learned correction value and air-fuel ratio feedback correction value.

7. A method of controlling the air-fuel ratio of an internal combustion engine according to claim 6, wherein said air-fuel ratio learned correction value is learned for each of a plurality of operating conditions divided by engine rotational speed and engine load.

8. A method of controlling the air-fuel ratio of an internal combustion engine according to claim 6, wherein said air-fuel ratio feedback correction value and air-fuel ratio learned correction value are correction terms respectively multiplied by the basic fuel supply quantity, so that when the exhaust temperature is less than or equal to a predetermined temperature, said air-fuel ratio feedback correction value is correctingly set with the deviation of the multiplied result of said air-fuel ratio feedback correction value and air-fuel ratio learned correction value, and said air-fuel ratio learned correction value as an additive correction value.

9. A method of controlling the air-fuel ratio of an internal combustion engine according to claim 6, wherein said exhaust temperature is indirectly detected on the basis of at least one of cooling water temperature, ambient temperature, engine load, and elapsed time from start.

10. A method of controlling the air-fuel ratio of an internal combustion engine according to claim 6, wherein said predetermined temperature is approximately 400 degrees C.

* * * * *